US009543683B2

(12) United States Patent
Leonhardt et al.

(10) Patent No.: US 9,543,683 B2
(45) Date of Patent: Jan. 10, 2017

(54) CONNECTOR HOUSING FOR AN ELECTRIC PLUG CONNECTOR

(71) Applicant: TE Connectivity Germany GmbH, Bensheim (DE)

(72) Inventors: Bernd Leonhardt, Kirchheim (DE); Bernd Manz, Schopfloch (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/798,836

(22) Filed: Jul. 14, 2015

(65) Prior Publication Data

US 2016/0013574 A1 Jan. 14, 2016

(30) Foreign Application Priority Data

Jul. 14, 2014 (DE) ..... 10 2014 213 659

(51) Int. Cl.

*H01R 13/514* (2006.01)
*H01R 13/436* (2006.01)
*H01R 13/50* (2006.01)
*H01R 13/52* (2006.01)

(52) U.S. Cl.

CPC ..... *H01R 13/436* (2013.01); *H01R 13/4362* (2013.01); *H01R 13/501* (2013.01); *H01R 13/5213* (2013.01)

(58) Field of Classification Search

CPC ..... H01R 13/4362
USPC ..... 439/752
See application file for complete search history.

(56) References Cited

U.S. PATENT DOCUMENTS 7,500,887 B2 * 3/2009 Ichio ..... H01R 13/4362 439/595
7,682,180 B2 * 3/2010 Brown ..... H01R 13/4223 439/352
8,430,689 B2 * 4/2013 Myer ..... H01R 13/5045 439/607.01

FOREIGN PATENT DOCUMENTS

DE 19919547 A1 11/1999
DE 10332892 A1 2/2005
DE 102012102966 A1 10/2013
EP 1176670 A1 1/2002
WO 2009134319 A1 11/2009

OTHER PUBLICATIONS

Office Action, Application No. 102014213659.8, dated Jun. 18, 2015; 5 pages.
Abstract of DE102012102966, dated Oct. 10, 2013, 1 page.

* cited by examiner

*Primary Examiner* — Phuong Dinh
(74) *Attorney, Agent, or Firm* — Barley Snyder

(57) ABSTRACT

A connector housing for an electrical connector has a housing body having one or more contact receiving passageways and one or more contact-securing members. Each contact-securing member is pivotably mounted on the housing body about a pivot axis, spaced apart from the pivot axis and extending parallel to the pivot axis, and pivotable about the pivot axis into the contact receiving passageway. The contact-securing member has a latching lug, a securing arm extending towards the contact receiving passageway, and a recess positioned on a side of the securing are opposite the latching lug.

18 Claims, 4 Drawing Sheets

CONNECTOR HOUSING FOR AN ELECTRIC PLUG CONNECTOR

CROSS-REFERENCE TO RELATED APPLICATION

This application claims priority under 35 U.S.C. §119(a)-(d) or (f) to German Patent Application No. 102014213659.8, filed Jul. 14, 2014.

FIELD OF THE INVENTION

The invention is generally related to an electrical connector, and, more specifically to an electrical connector having a pivotable contact-securing member.

BACKGROUND

Conventional electrical connectors often have connector housings that secure the position of electric contacts, such as pin contacts. The electrical contacts generally have regions which form a positive fit with a contact-securing member formed in the housing and extending in at least one direction. In this manner, an undesirable removal of an installed electrical contact from the housing can be prevented. However, these conventional electrical connectors are known to suffer from the fact that the contact-securing notch design often break if manufactured imprecisely and/or if excessive forces act on them.

Publication DE 10 2012 102 966 A1, filed by the Applicants, describes a plug element in which the contact-securing member has at least one elongation portion. As a result, it is elastic and manufacturing tolerances can be compensated. Various described embodiments show contact-securing members having large openings which extend along a pivoting direction through a contact-securing member of the connector housing. While this configuration of a contact-securing member has good elasticity, it suffers from several disadvantages. For example, since an outer surface of the contact-securing member has a number of openings extending over a large area, and the majority are used for the elongation portion, the use of an outside of the contact-securing element for additional elements is no longer possible. For example, handles, latching elements or inscriptions cannot be positioned in the region of the elongation portion. In addition, manufacturing such a contact-securing member and housing is very complex, because the structures of the elongation portions and the structure of the latching lug can only be produced with injection-moulding method by a combination of lateral slides which are movable in different directions. This means that even small changes in the configuration of the elongation portion or the latching lug, require large portions of the tools used, including the lateral slides, to be redesigned or reconfigured. This is generally expensive and complex, and greatly limits the variety of connectors that can realistically be produced.

SUMMARY

A connector housing for an electrical connector has a housing body having one or more contact receiving passageways and one or more contact-securing members. Each contact-securing member is pivotably mounted on the housing body about a pivot axis, spaced apart from the pivot axis and extending parallel to the pivot axis, and pivotable about the pivot axis into the contact receiving passageway. The contact-securing member has a latching lug, a securing arm extending towards the contact receiving passageway, and a recess positioned on a side of the securing are opposite the latching lug.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
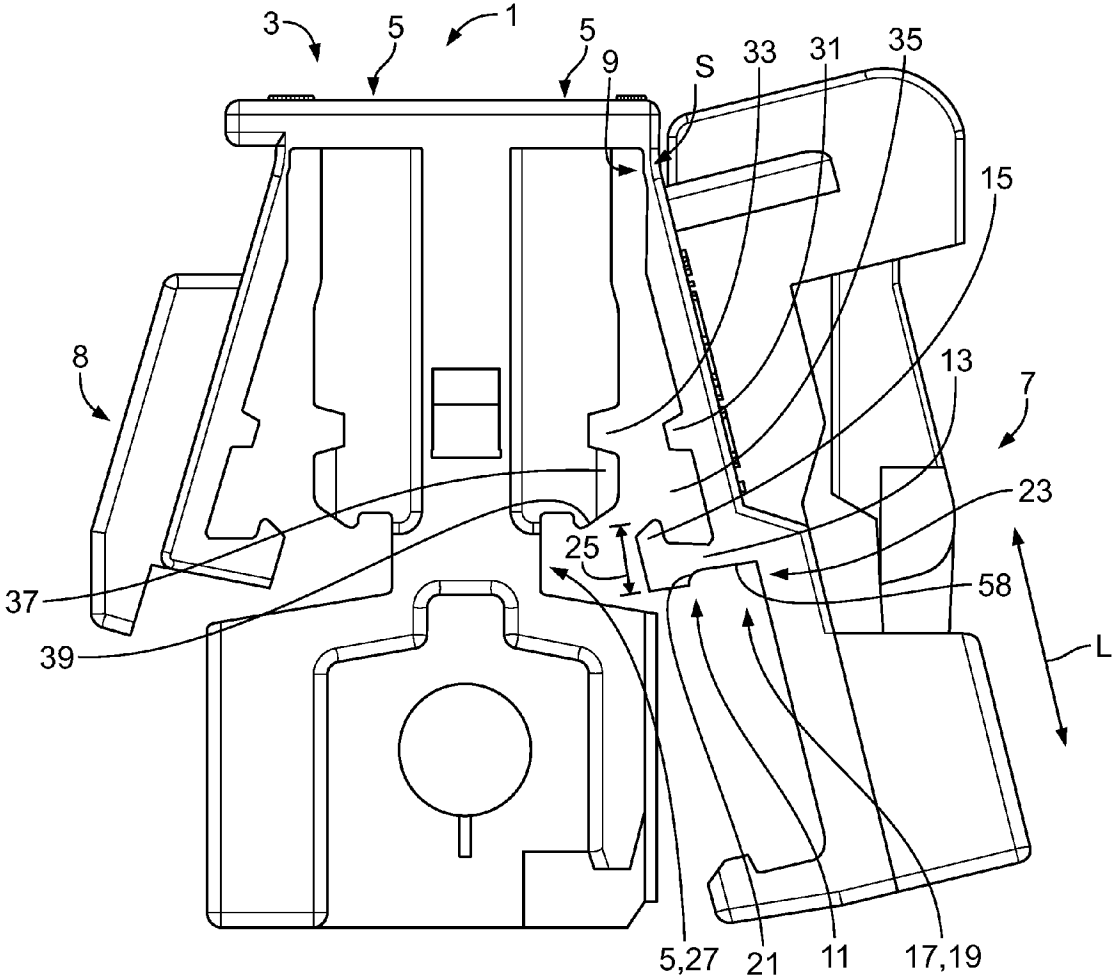
FIG. 1 is a side view of a pivot axis of a connector housing.

In an embodiment shown in FIG. 1, a connector housing 1 has a pivot axis S. The connector housing 1 includes a housing body 3. The housing body 3 has a row of contact receiving passageways 5 for receiving electrical contacts (not illustrated). The contact receiving passageways 5 extend through housing body 3. The connector housing 1 includes a contact-securing member 7. The contact-securing member 7 is mounted pivotably on housing body 3 about pivot axis S, being formed integrally with housing body 3 and being connected thereto via an integral hinge 9. In an embodiment, the integral hinge 9 forms pivot axis S.

The contact-securing member 7 extends along longitudinal direction L away from pivot axis S, and has a contact-securing member 11 spaced apart from pivot axis S in a longitudinal direction L. The contact-securing member 11 extends along pivot axis S so that it can be used to secure a plurality of electrical contacts. As a result of the pivotable mounting of contact-securing member 7 on housing body 3, contact-securing member 11 is pivotable into contact receiving passageway 5 about pivot axis S.

The contact-securing member 11 has a securing arm 13 extending towards contact receiving passageway 5 and a latching lug 15 positioned on a free end thereof and pointing in the longitudinal direction. A hook-shaped cross-sectional is produced by securing arm 13 and latching lug 15. The latching lug 15 is positioned to point in the direction of pivot axis S. the securing arm 13 has recess 19 on a side 17 opposite the latching lug 15. The recess 19 provides the securing arm 13 with the required elasticity. In an embodiment, the recess 19 has an arcuate end 21 extending towards the housing body 3, and an angled end 23 which represents a transition to the contact-securing member 7. Those of ordinary skill in the art would appreciate, however, that other configurations are also conceivable. For example, both ends 21, 23 of recess 19 can be configured to be arcuate or also angled. In a manufacturing process of the connector housing 1, the recess 19 is formed by a fixed tool part (not shown) in an injection-moulding process.

The contact-securing member 11 has a substantially hammer-like shape as a result of a combination of the latching lug 15 and recess 19. A total length 25 of contact-securing member 11 in longitudinal direction L can be defined by the dimension and configuration in connector housing 1 of the electric contact elements used therein. An elastic contact-securing member 11 can therefore be obtained by the recess 19 without the total length 25 of contact-securing member 11 being changed in comparison to a configuration without the recess 19.

The contact receiving passageways 5 in housing body 3 each have a securing arm receiving groove 27 having a complimentary shape to the contact-securing member 11. The securing arm receiving groove 27 extends approximately parallel to the pivot axis S, and the contact-securing member 11 is pivoted into securing arm receiving groove 27 and thus into contact receiving passageways 5.

The contact-securing member 7 has rib 31 positioned between contact-securing member 11 and pivot axis S. The rib 31 lies in longitudinal direction L between contact-securing member 11 and pivot axis S and runs parallel to pivot axis S. The rib 31 is pivotable into a corresponding rib receiving space 33 disposed on housing body 3. The contact-securing member 11 is pivotable into stated securing arm receiving groove 27. A receiving space 35 is formed between the rib 31 and contact-securing member 11.

The contact receiving passageways 27,33 are configured such that a latching head 37 is formed on housing body 3. The latching head 37 can be latched with the contact-securing member 11. As a result, the contact-securing member 7 can be fastened to housing body 3. The latching head 37 includes a counter-latching lug 39 which is positioned opposite to the contact-securing member 11 in longitudinal direction L of latching lug 15. If the latching head 37 is latched with latching lug 15, the latching lugs 15 and 39 engage in one another, creating a positive locking that prevents a pivoting of contact-securing member 7 away from housing body 3. The latching head 37 is then received in the receiving space 35 of contact-securing member 7. In the latched state, the rib 31 is positioned in the rib receiving space 33. As a result, a movement of the contact-securing member 7 away from pivot axis S can be prevented if, for example, the integral hinge 9 is damaged. In this manner, secure retention of contact-securing member 7 on housing body 3 can be ensured.

The embodiment shown in FIG. 1 has a second contact-securing member 8 which is positioned opposite contact-securing member 7 for a second row of contact receiving passageways 5. While the second contact-securing member 8 is not described in detailed, those of ordinary skill in the art would appreciate that the second contact-securing member 8 having can include any or all of the elements described in regards to the contact-securing member 7 and be positioned on the opposite side of connector housing 1 to that of the contact-securing member 7.

Figure 2:
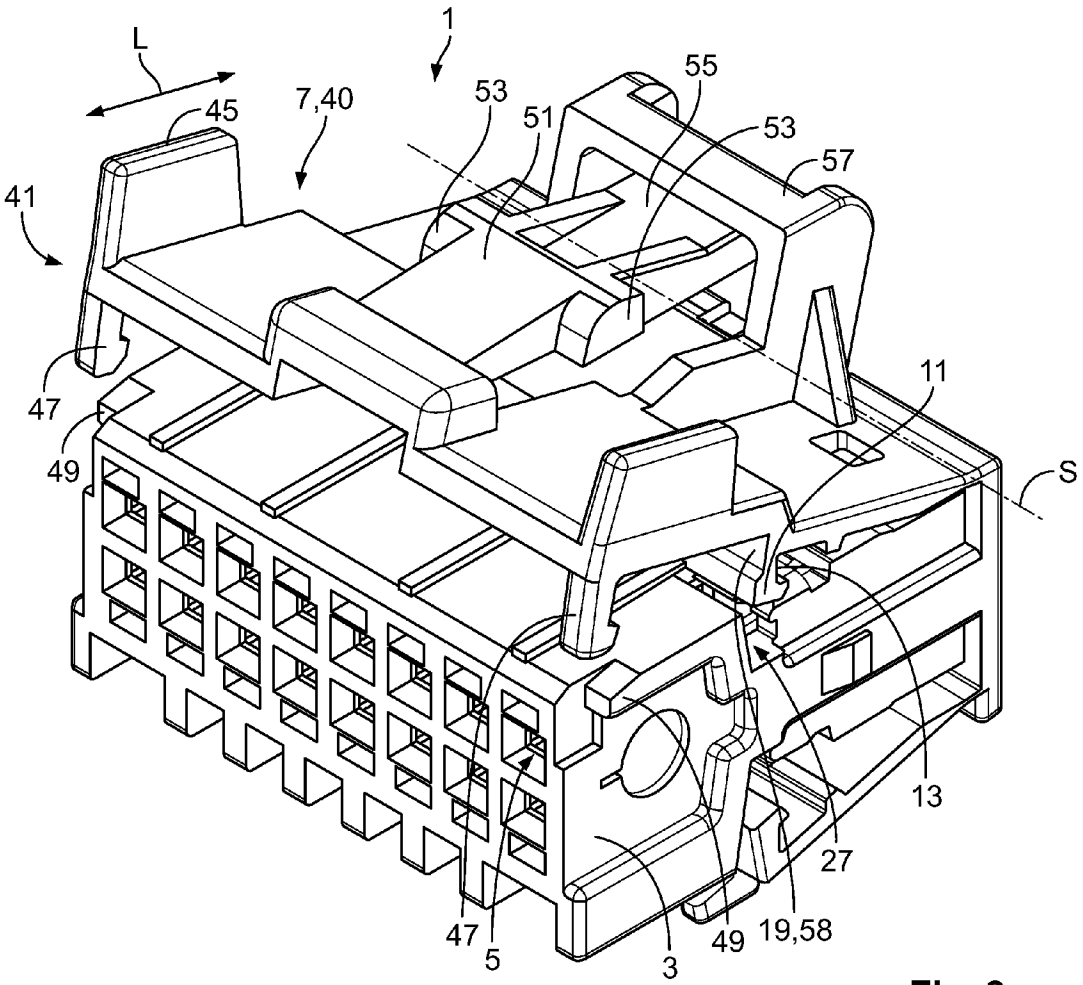
FIG. 2 is a perspective view of the connector housing.

In an embodiment shown in FIG. 2, the housing body 3 includes a plurality of contact receiving passageways 5 which are arranged next to one another parallel to pivot axis S. The securing arm receiving groove 27 for contact-securing member 11 also extends parallel to pivot axis S, with the result that it at least partially opens all contact receiving passageways 5 arranged next to one another.

The contact-securing member 7 is configured substantially as a cover 40, such that it at least partially protect housing body 3 if it is pivoted towards housing body 3. As already described, the cover-type configuration of contact-securing member 7 is only possible in that the desired elasticity of contact-securing member 11 at securing arm 13 is generated, with the result that remaining contact-securing member 7 can have high stability.

In an embodiment, the contact-securing member 7 has two reinforcing ribs 45 positioned at a contact receiving end 41 pointing away from pivot axis S and on a mating side side 43 facing away from housing body 3. The reinforcing ribs 45 extend away from housing body 3 and along longitudinal direction L, and can serve to code a preferred orientation of connector housing 1 when connecting to a mating plug element.

In a region of the reinforcing ribs 45, two further latching hooks 47 extend towards the housing body 3 to latch with counter-latching elements 49 positioned on housing body 3, thus fastening the contact-securing member 7 to housing body 3 when it is pivoted towards the housing body 3. This is helpful particularly if, as in the described embodiment, the contact-securing member 7 extends in the longitudinal direction beyond contact-securing member 11.

An elastically deflectable latching element 51 is also positioned on the contact-securing member 7. The latching element 51 is connected to the contact-securing member 7 at the mating end 41 pointing away from pivot axis S, and extends away in the direction of the pivot axis S and obliquely away from the contact-securing member 7. The latching element 51 can be deflected elastically towards the remaining contact-securing member 7, and can be used for latching with a mating plug element (not shown). For example, a mating plug element can have cut-outs in which projections 53 of latching element 51 can engage in order to connect connector housing 1 to a mating plug element. At the free end 55, the latching element 51 can be deflected, for example, by a person in the direction of contact-securing member 7. For protection of latching element 51, the contact-securing member 7 has, on side 43 facing away from the housing body, a safety bar 57 which partially surrounds the latching element 51 at a free end 55. As a result, the latching element 51 is secured against an undesirable deflection away from housing body 3.

In the above described embodiments, the recess 19 on securing arm 13 of contact-securing member 11 is parallel to pivot axis S with a continuous base 58. An embodiment shown in FIG. 3 differs from the embodiments shown in FIGS. 1 and 2 only in the configuration of contact-securing member 11. For this reason, only the differences from the embodiments of FIGS. 1 and 2 are described in detail.

Figure 3:
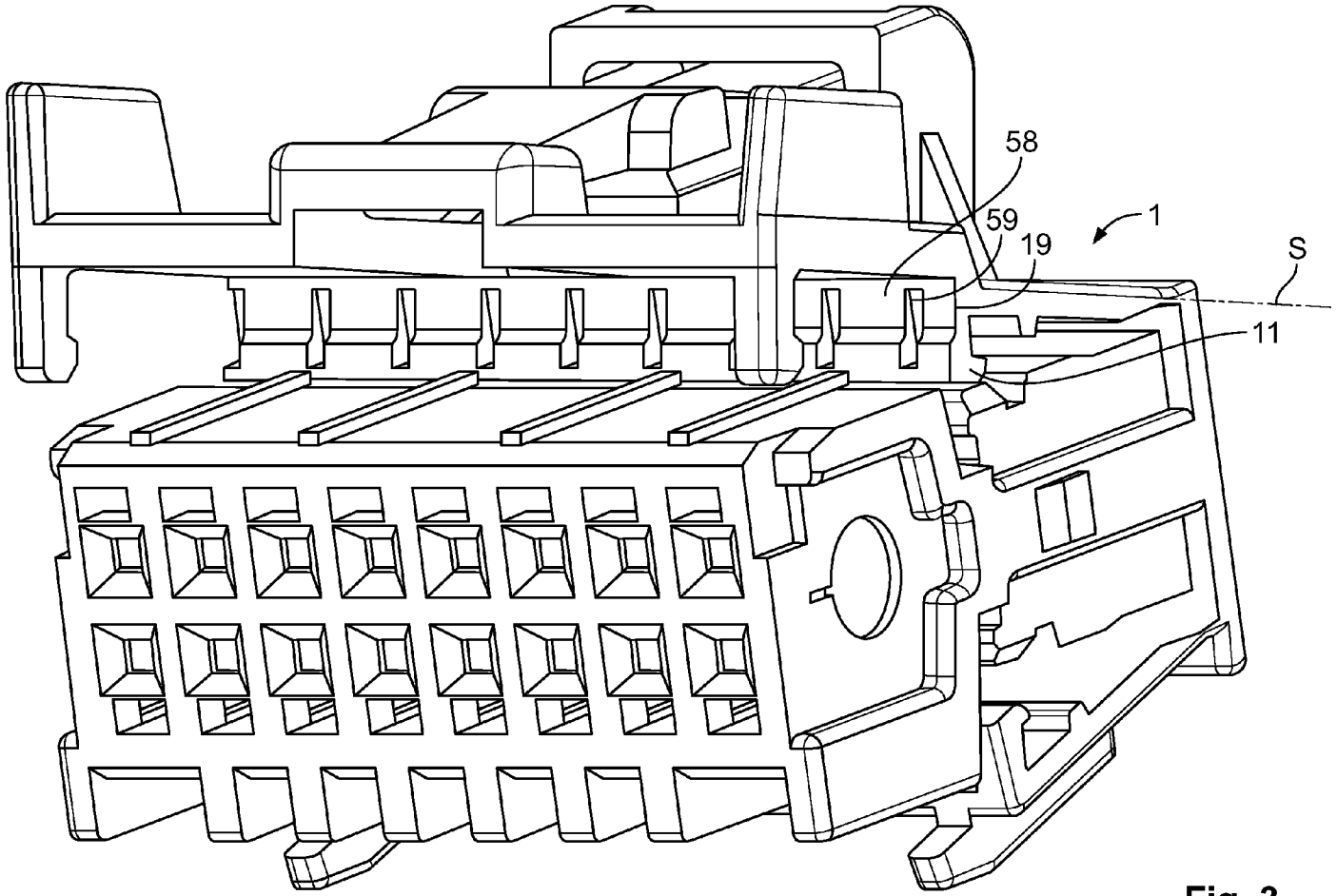
FIG. 3 is a perspective view of the connector housing.

As shown in FIG. 3, the contact-securing member 11 has a recess 19. Additional depressions 59 are arranged on base 58 of recess 19. The depressions 59 extend in the longitudinal direction into contact-securing member 11, being substantially longitudinal and running transverse to the pivot axis S. The depressions 59 extend beyond the region of recess 19 into the region of latching lug 15, permitting the elasticity or the rigidity of contact-securing member 11 to be adjusted.

Additionally, the depressions 59 can be shaped by a fixed tool part (not shown) like recess 19 during manufacture of a connector housing according to the invention. The depressions 59 run equidistantly parallel to the pivot axis S such that they are evenly distributed across the profile of contact-securing member 11. In an embodiment, the depressions 59 have different suitable shapes, such as blind holes.

Figure 4:
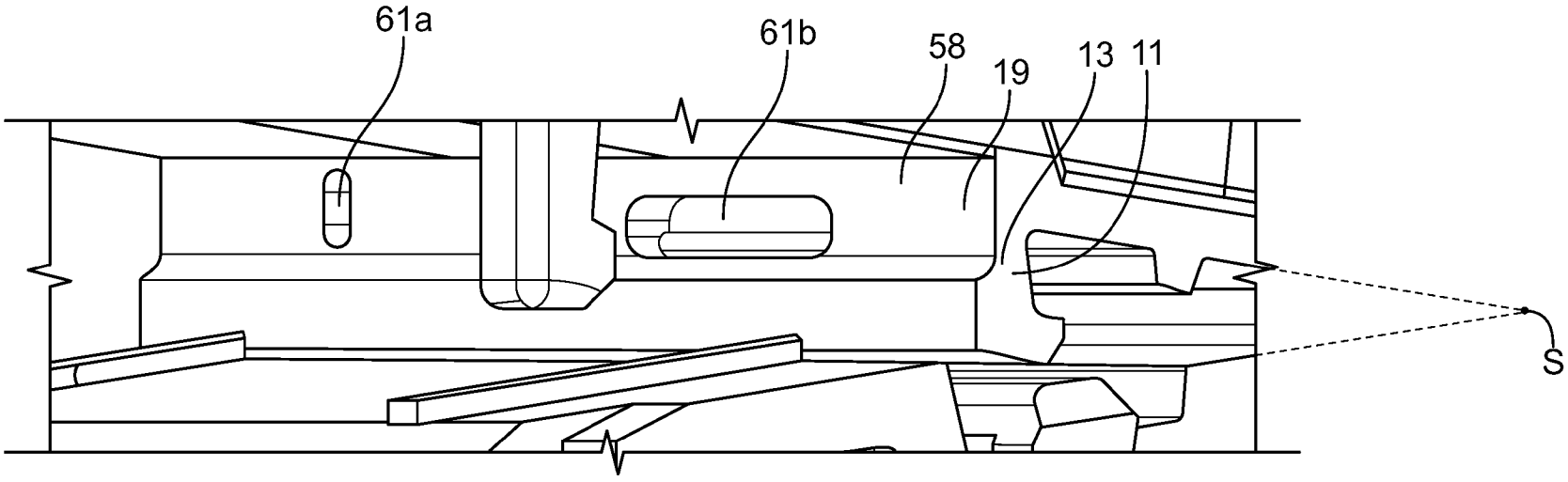
FIG. 4 is an enlarged perspective view of a contact-securing member.

In an embodiment shown in FIG. 4, the contact-securing member 11 has a continuous recess 19 extending parallel to the pivot axis S. The contact-securing member 11 has apertures 61*a*, 61*b* disposed at a base 58 of the recess 19. The apertures 61*a*, 61*b* can penetrate fully, in particular, through the securing arm 13. As shown in FIG. 4, two apertures 61*a* and 61*b* of different shapes are disclosed, although these shapes can be interchangeable between the two apertures 61*a*, 61*b*, or have other shapes. The aperture 61*a* runs longitudinally in a direction transverse to pivot axis S and the aperture 61*b* runs longitudinally parallel to pivot axis S. A contact-securing member 11 can therefore have, for example, one or more apertures according to aperture 61*a* and/or apertures according to aperture 61*b*, depending on which requirements are placed on contact-securing member 11.

What is claimed is:

1. A connector housing for an electrical connector, comprising a housing body having:

one or more contact receiving passageways; and one or more contact-securing members pivotably mounted on the housing body about a pivot axis, spaced apart from the pivot axis and extending parallel to the pivot axis, and pivotable about the pivot axis into the contact receiving passageway, each having:

a latching lug, a securing arm extending towards the contact receiving passageway, a recess positioned on a side of the securing arm opposite the latching lug, and a rib spaced apart from the securing arm and extending parallel to the pivot axis.

2. The connector housing according to claim 1 further comprising an integral hinge on the pivot axis.

3. The connector housing according to claim 1, wherein the contact-securing member is integrally formed with the housing body.

4. The connector housing according to claim 1, wherein the contact-securing member is a cover positioned over the housing body.

5. The connector housing according to claim 1, wherein the housing body has a rib receiving space positioned a distance from the pivot axis, and extending approximately parallel to the pivot axis.

6. The connector housing according to claim 5, wherein the rib is pivotable into the rib receiving space.

7. The connector housing according to claim 6, wherein each of the contact receiving passageways have a securing arm receiving groove positioned approximately parallel to the pivot axis, extending through the housing body, and exposing the contact receiving passageways.

8. The connector housing according to claim 7, wherein:

the housing body includes a latching head with a counter-latching lug positioned between the rib receiving space and the securing arm receiving groove, the latching lug engaging the counter-latching lug and connecting the contact securing member to the housing body with a positive locking force.

9. The connector housing according to claim 1, wherein the contact-securing member has one or more reinforcing elements extending substantially in the longitudinal direction on a side facing away from the housing body.

10. The connector housing according to claim 9, wherein the reinforcing element further includes a latching hook extending towards the housing body.

11. The connector housing according to claim 1, wherein the contact-securing member further includes an elastically deflectable mating plug latching element on a side facing away from the housing body.

12. The connector housing according to claim 11, wherein the contact-securing member has a safety bar that partially surrounds the elastically deflectable latching element.

13. The connector housing according to claim 1, wherein the contact-securing member has alternating regions of increased and reduced wall thickness in a region of the recess, the alternating regions extending in a direction parallel to the pivot axis.

14. The connector housing according to claim 1, wherein the recess has a recess base with one or more depressions.

15. The connector housing according to claim 1, wherein the contact-securing member has at least one aperture positioned proximate to the recess and extending approximately perpendicular to the pivot axis.

16. A connector housing for an electrical connector, comprising a housing body having:

one or more contact receiving passageways; and one or more contact-securing members pivotably mounted on the housing body about a pivot axis, spaced apart from the pivot axis and extending parallel to the pivot axis, and pivotable about the pivot axis into the contact receiving passageway, each having:

a latching lug, a securing arm extending towards the contact receiving passageway, a recess positioned on a side of the securing arm opposite the latching lug, and one or more reinforcing elements extending substantially in the longitudinal direction on a side facing away from the housing body.

17. The connector housing according to claim 16, wherein the reinforcing element further includes a latching hook extending towards the housing body.

18. A connector housing for an electrical connector, comprising a housing body having:

one or more contact receiving passageways; and one or more contact-securing members pivotably mounted on the housing body about a pivot axis, spaced apart from the pivot axis and extending parallel to the pivot axis, and pivotable about the pivot axis into the contact receiving passageway, each having:

a latching lug, a securing arm extending towards the contact receiving passageway, and a recess positioned on a side of the securing arm opposite the latching lug, with alternating regions of increased and reduced wall thickness in a region of the recess extending in a direction parallel to the pivot axis.

* * * * *